US009096296B2

(12) United States Patent
Duff

(10) Patent No.: US 9,096,296 B2
(45) Date of Patent: Aug. 4, 2015

(54) TOW ROPE SYSTEM AND ASSOCIATED METHODS

(75) Inventor: Glen Wade Duff, Williamsburg, VA (US)

(73) Assignee: ZUP LLC, Williamsburg, VA (US)

( * ) Notice: Subject to any disclaimer, the term of this patent is extended or adjusted under 35 U.S.C. 154(b) by 218 days.

(21) Appl. No.: 13/603,530

(22) Filed: Sep. 5, 2012

(65) Prior Publication Data

US 2013/0017742 A1 Jan. 17, 2013

Related U.S. Application Data

(63) Continuation-in-part of application No. 12/592,759, filed on Dec. 2, 2009, now Pat. No. 8,292,681.

(60) Provisional application No. 61/200,637, filed on Dec. 2, 2008.

(51) Int. Cl.
*B63B 35/81* (2006.01)

(52) U.S. Cl.
CPC ..... *B63B 35/816* (2013.01); *B63B 35/817* (2013.01)

(58) Field of Classification Search
CPC ..... B63B 35/817
USPC ..... D21/777; 114/253; 441/69
See application file for complete search history.

(56) References Cited

U.S. PATENT DOCUMENTS 3,092,068 A 6/1963 Brownson
3,219,007 A 11/1965 Kiefer
3,304,904 A 2/1967 Spurlock
3,918,114 A 11/1975 Schmitt
4,069,786 A 1/1978 La Botz
4,392,833 A 7/1983 Hayden
4,592,734 A 6/1986 Metiver
4,678,444 A 7/1987 Monreal
4,867,722 A 9/1989 Joseph
D304,061 S * 10/1989 Raiter et al. ..... D21/777
4,989,531 A 2/1991 Humphrey
5,083,955 A 1/1992 Echols
5,163,860 A 11/1992 Clark
5,167,553 A 12/1992 Wilson
5,376,207 A * 12/1994 Pittman ..... 156/242
5,427,047 A 6/1995 Woodfin et al.
5,447,116 A 9/1995 Kobayashi
5,503,580 A * 4/1996 McCarthy ..... 441/69
5,634,834 A 6/1997 Cole et al.
5,797,779 A 8/1998 Stewart
5,820,430 A 10/1998 Hornsby et al.
6,007,394 A 12/1999 Kagan
6,585,549 B1 7/2003 Fryar (Continued)

*Primary Examiner* — Edwin Swinehart
(74) *Attorney, Agent, or Firm* — Berenato & White, LLC

(57) ABSTRACT

A tow rope system for use with a water recreation device may include a first drawbar member positioned to overlie a second drawbar member and oriented to be inverted with respect to the second drawbar member. Each of the first and second drawbar members may include a grip connected to opposing lateral supports. A coupling member may be connected to a portion of each of the opposing lateral supports, resulting in the first and second drawbar members extending outwardly from the coupling member in an angled configuration. The grip of each drawbar member may present both a gripping surface for a water recreation device rider and a mechanical engagement surface for a tow hook on a water recreation device. The dual-drawbar configuration may facilitate both passive and active towing of a water recreation device rider, and also both traditional and ergonomic gripping by a rider.

15 Claims, 8 Drawing Sheets

(56) References Cited

U.S. PATENT DOCUMENTS

| | | | | |
|---|---|---|---|---|
| 7,216,600 | B1 | 5/2007 | Hamilton et al. | |
| 1,360,357 | A1 | 9/2012 | Duff et al. | |
| 8,292,681 | B2 | 10/2012 | Duff | |
| 2006/0185571 | A1 * | 8/2006 | Leseberg | 114/253 |

* cited by examiner

TOW ROPE SYSTEM AND ASSOCIATED METHODS

RELATED APPLICATIONS

This application is a continuation in part of U.S. patent application Ser. No. 12/592,759 titled Water Recreation Device filed on Dec. 2, 2009, which, in turn, claims the benefit of U.S. Provisional Patent Application No. 61/200,637 filed on Dec. 2, 2008, the entire contents of each of which are incorporated herein by reference. This application is also related to U.S. patent application Ser. No. 13/603,579 titled Multifunction Engagement Apparatus for a Water Recreation Device and Associated Methods, filed simultaneously herewith, the entire contents of which are also incorporated herein by reference.

FIELD OF THE INVENTION

The present invention relates generally to the field of water recreation devices and particularly to devices and methods for towing a water recreation device and its rider behind a water vehicle.

BACKGROUND OF THE INVENTION

Water sports, such as wake boarding, commonly require use of a tow bar system to pull a rider on a water recreation device along the surface of the water behind a powerboat. A typical tow bar system includes a tow line and hand grips. Depending on the types and durations of maneuvers a rider wishes to perform, the rider may prefer a tow bar system that employs a more traditional single-grip configuration or, alternatively, that features an individual grip for each hand (e.g., dual grip). Furthermore, to achieve desired performance and/or maximize enjoyment during a single ride, the rider may prefer to selectively alternate between dual-grip and single-grip modes.

However, current tow bar systems can be difficult for a rider (particularly a novice rider) to effectively use. For example, inexpensive single-grip tow bars routinely force the rider's hands together for two-hand gripping while the recreation device is in motion, thereby limiting the rider's ability to physically adjust her grip for comfort, energy-conservation, and/or performance purposes. Furthermore, both the single-grip and dual-grip tow bar systems can be difficult to hold onto during the rider's transition from being pulled out of the water at the start of a ride to being accelerated to planing speed during the course of a ride.

Several dual-grip tow bar systems exist for use by a rider of a water recreation device. For example, a tow line characterized by the provision of two grips, one for each hand of a water skier, is disclosed in U.S. Pat. No. 3,092,068 to Brownson et al. ("Brownson"), U.S. Pat. No. 4,069,786 to La Botz ("La Botz"), U.S. Pat. No. 3,219,007 to Kiefer et al. ("Kiefer"), U.S. Pat. No. 3,304,904 to Spurlock et al. ("Spurlock"), U.S. Pat. No. 4,392,833 to Hayden ("Hayden"), and U.S. Pat. No. 4,867,722 to Joseph ("Joseph"). However, neither the free-standing dual grips shown in the Brownson and La Botz references nor the convertible dual grips described in the Kiefer, Spurlock, Hayden, and Joseph references maintain a substantially fixed orientation in relation to each other when used in dual-grip mode because each grip is mechanically supported only by tow rigging consisting entirely of ropes. These dual-grip designs implemented with loose rigging have some performance advantages, but they compromise rider comfort and energy. Specifically, the skier must rely on muscle strength both to hang on to the grips during the transition from pullout to planing speed, and also to maintain the grips in a functional orientation while being pulled. Such exertion may cause the rider to tire before she can sufficiently enjoy the ride on a recreation device.

To help a rider maintain comfort and conserve energy, releasable towing systems offer, among other advantages, an opportunity for a rider of a water recreation device to passively ride while the tow line is affixed to the board itself, Releasable towing systems for water recreation devices are disclosed in La Botz and also in U.S. Pat. No. 4,989,531 to Humphrey, U.S. Pat. No. 5,083,955 to Echols, and U.S. Pat. No. 5,163,860 to Clark. For example, the La Botz and Humphrey references both describe adding an intermediate hooking mechanism to a conventional tow line that a rider may use to snag an anchor member affixed to a water recreation device for the purpose of towing. Similarly, the Echols reference describes draping from a tow line a coupling device that mates with a retainer mounted on the surface of a water recreation device. However, these systems pose one or both of the following challenges for a rider, and particularly for a novice rider: 1) manipulating a small hooking mechanism to release it from an anchor member while in the process of being towed, and 2) managing the instability of a single-grip or dual-grip tow bar system that is loosely tethered by ropes. Both the Echols and Clark patents disclose presenting a recess in the top surface of a water recreation device to accommodate a tow bar. However, these single-grip tow bars expose the rider's hands to being pinched between the tow bar and the board when the rider attempts to remove the substantially planar tow bar from a low-profile tow hook or from a recess in the board's surface.

SUMMARY OF THE INVENTION

With the above in mind, the present invention advantageously provides a tow rope system that presents a structure with enhanced stability to facilitate selective use for both passive and active towing of a rider on a water recreation device. The present invention further advantageously provides methods by which a dual drawbar may be selectively released and engaged with a tow hook on a water recreation device, and by which a dual drawbar may be selectively positioned for traditional and ergonomic gripping by a towed rider of a water recreation device. For purposes of this disclosure, a drawbar is a bar or other stable device to which a load to be pulled may be hitched or otherwise coupled.

These and other objects, features, and advantages according to the present invention are provided by a tow rope system that may comprise first and second drawbar members, each of which may include a grip and opposing lateral supports that may be connected to the grip. Each of the drawbar members' opposing lateral supports may be connected to a coupling member. The first drawbar member may overlie the second drawbar member in an inverted position. The first and second drawbar members may extend outwardly from the coupling member in an angled configuration.

Each of the first and second drawbar members may have a dosed geometric shape which may define an enclosed void. For example, and without limitation, each drawbar member may be substantially triangular. Each lateral support of each of the drawbar members may have a posterior end connected to the grip and an anterior end connected to the coupling member. The first and second drawbar members may be aligned in a substantially symmetrical configuration.

The grips on the first and second drawbar members may be spaced apart from each other. The grips on the first and second drawbar members may curve outward from each other. The grip and the lateral supports of each of the drawbar members may be integrally formed as a monolithic unit. The first and second drawbar members and the coupling member may be integrally formed as a monolithic unit.

The coupling member may comprise at least one gusset adjacent the first and second drawbar members. The gusset(s) may be elastic to allow the angle between the first and second drawbar members to vary. For example, and without limitation, the range of the angle may vary between about 15 and 30 degrees. A pair of opposing gussets may be spaced apart from each other between the first and second drawbar members. The grip and lateral supports of the first and second drawbar members, as well as the coupling member and any gussets, may be integrally formed as a monolithic unit.

A tow rope may be connectable to an anterior end of the coupling member, A leader may have a first end connected to the coupling member and may have a second end connected to a tow rope.

A portion of the grip on either drawbar member may be adapted to engage a tow hook on a water recreation device, and another portion of the grip may present a textured gripping surface to a rider of a water recreation device. Each of the first and second drawbar members may be constructed of one or more rubber, plastic, aluminum, and carbon.

A method aspect of the present invention is for towing a rider on a water recreation device on a body of water. The method may include engaging a contact surface on the grip of a drawbar member with a tow hook, The contact surface may be positioned substantially central on the grip of the drawbar member.

The method may include a rider grasping the first drawbar member grip in a substantially central position, and removing the tow rope from the tow hook by pulling the grip of the first drawbar member to disengage the grip of the second drawbar member from the tow hook. The method may further include the rider raising the grip of the first drawbar member away from the surface of the riding board, thereby causing the grip of the second drawbar member to hang freely and oriented substantially parallel to the surface of the riding board.

The method may include the rider repositioning the tow rope system for ergonomic use by removing one of two hands from the grip of the first drawbar member, using the free hand to grasp the grip of the second drawbar member substantially central on the grip of the second drawbar member in an underhand technique, and rotating the grips of the first and second drawbar members to achieve a substantially vertical orientation of the two grips.

The method may include a rider repositioning the tow rope system for traditional use by rotating the grips of the first and second drawbar members to achieve a substantially horizontal orientation, removing a hand from the grip of the second drawbar member, using the free hand to grasp the grip of the first drawbar member, and positioning both hands of the rider in an overhand technique on the grip of the first drawbar member.

The method may include a rider lowering the grip of the first drawbar member toward the surface of the riding board, pushing the grip of the first drawbar member away from the rider to cause mating of the grip of the second drawbar member with the tow hook, engaging a contact surface on the grip of the second drawbar member with the tow hook, and removing the hands of the rider from the grip of the first drawbar member.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1A, 1B, 1C, 1D, 1E, and 1F, a tow rope system 100 according to the present invention is now described in greater detail. The tow rope system 100, according to an embodiment of the present invention, advantageously may be selectively used for both passive and active towing of a rider on a water recreation device. Active towing may be accomplished by presenting the tow rope system 100 for gripping by a rider of a water recreation device. Passive towing may be accomplished by directly engaging the tow rope system 100 with a water recreation device.

Figure 1A:
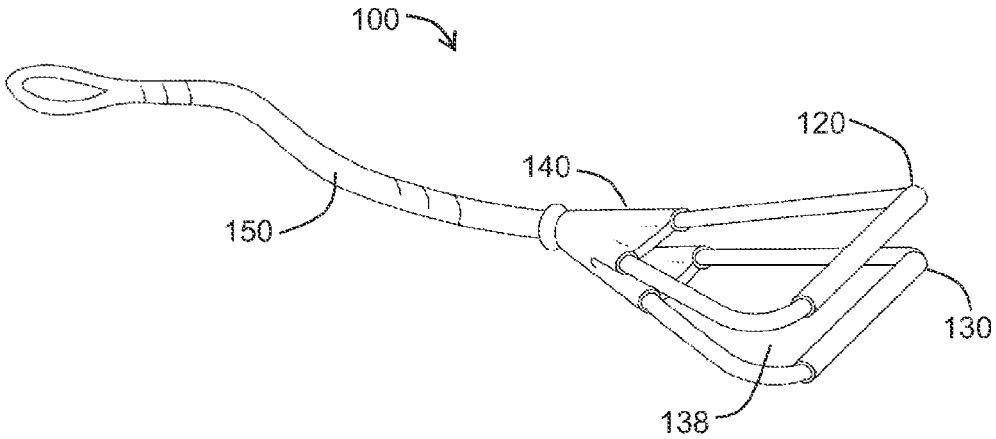
FIG. 1A is a top perspective view of a tow rope system according to an embodiment of the present invention.
Figure 1B:
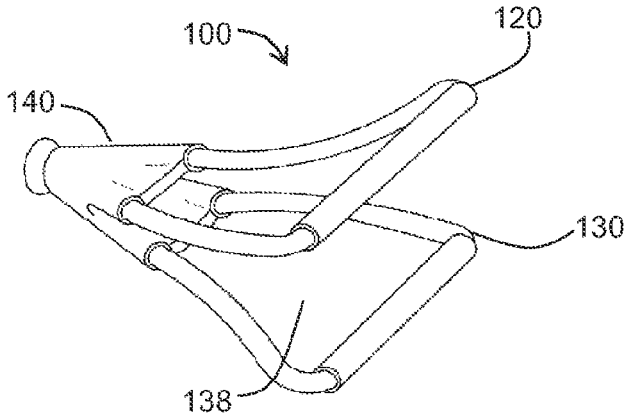
FIG. 1B is a top perspective view of first and second drawbar members of a tow rope system according to an alternative embodiment of the present invention.

As shown in the alternative embodiments of FIGS. 1A and 1B, the tow rope system 100 may include a first drawbar member 120 and a second drawbar member 130. The tow rope system 100 may also include a coupling member 140. As discussed in greater detail below, the first drawbar member 120, second drawbar member 130, and coupling member 140 may be provided in several different shapes and configurations to achieve the objects, goals, features and advantages of the present invention.

For example, and without limitation, the first drawbar member 120 may be positioned to overlie the second drawbar member 130. The two drawbar members may be aligned in a substantially symmetrical configuration with respect to a common plane defined equidistant from both the first drawbar member 120 and the second drawbar member 130. The first drawbar member 120 may be inverted with respect to the second drawbar member 130. Those skilled in the art will appreciate, after having had the benefit of reading this disclosure, that the size of the drawbar members 120, 130, as well as the distance of the drawbar members 120, 130 from the common plane described above, may be tailored to satisfy the varying use characteristics, such as performance and ease of operation, desired by water recreation device riders of differing skill levels and recreation interests.

Still referring to FIGS. 1A and 1B, each of the drawbar members 120, 130 may present a closed geometric shape. For example, and without limitation, both the first drawbar member 120 and the second drawbar member 130 may be substantially triangular in shape to take advantage of a triangle's strength and stability under load. Also, the closed geometric shape may define an enclosed void 138 which not only may facilitate gripping of a side of the closed geometric shape but also may save material cost during manufacture of a drawbar member. Those skilled in the art will appreciate, after having had the benefit of reading this disclosure that drawbar members 120, 130 may be constructed in other than substantially triangular shapes and/or without defining an enclosed void.

Referring to FIG. 1B, in one embodiment, a tow rope (not shown) may be connectable to an anterior portion 147 of the coupling member 140. Referring to FIG. 1A, in yet another embodiment, a tow rope (not shown) may be connectable to a leader 150 which may, in turn, be connected to an anterior portion 147 of the coupling member 140. Those skilled in the art will appreciate, after having had the benefit of reading this disclosure, that providing support for a leader 150 (illustrated in FIG. 1A) as an optional means for connecting a tow vehicle, such as a powerboat, to the towing system 100 offers flexibility in terms of types of towing rigs that may make constructive use of the towing system 100. In yet another example, and without limitation, the leader 150 may be molded during manufacturing as an integral part of the tow rope system 100.

Figure 1C:
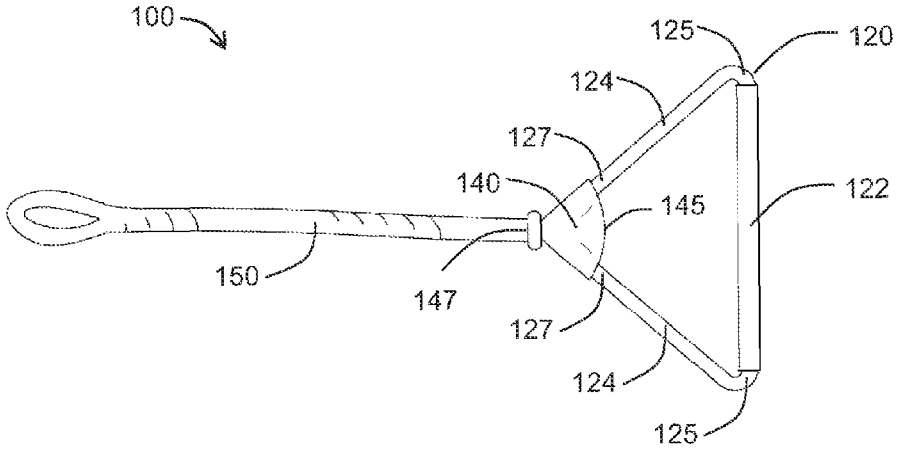
FIG. 1C is a top plan view of the tow rope system illustrated in FIG. 1A.
Figure 1D:
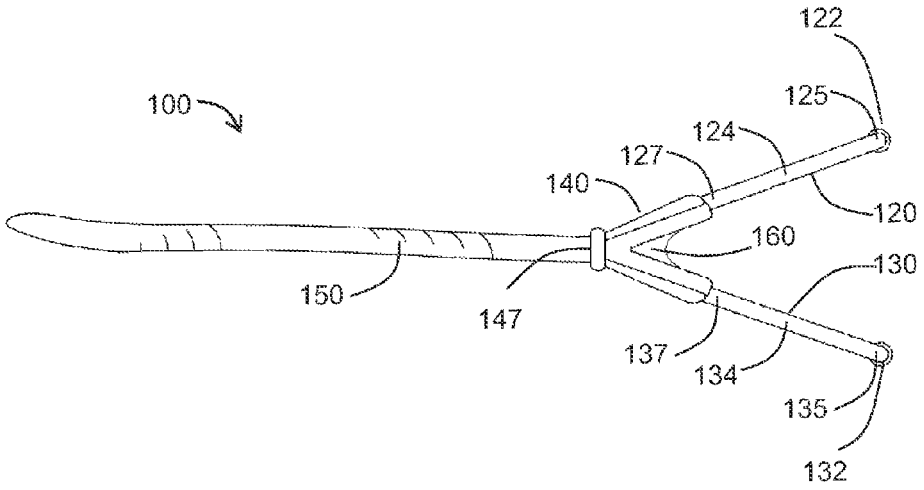
FIG. 1D is a left side elevation view of the tow rope system illustrated in FIG. 1A.

Referring now to FIGS. 1C and 1D, drawbar member 120 may include a grip 122, and opposing lateral supports 124 that may be connected to the grip 122 and also coupled with each other by the coupling member 140 in such a way as to present a stable geometric shape. For example, and without limitation, FIG. 1C illustrates the stable geometric shape defined by drawbar member 120 as substantially triangular. As shown in FIG. 1D, drawbar member 130 may include a grip 132, and opposing lateral supports 134 that may be connected to the grip 132 and also coupled with each other by the coupling member 140 in such a way as to present a stable geometric shape. Both of the grips 122, 132 may be dual-use, meaning that either may be grasped by a rider of a water recreation device for active towing and also that either may be engaged directly with a water recreation device for passive towing. For example, and without limitation, each lateral support 124 may have an posterior end 125 that may be connected to a portion of the grip 122 and an anterior end 127 operably coupled with an opposing lateral support 124 by a coupling member 140 as described in greater detail below. Similarly for example, and without limitation, each lateral support 134 may have a posterior end 135 that may be connected to a portion of the grip 132 and an anterior end 137 operably coupled with an opposing lateral support 134 by a coupling member 140 as described in greater detail below.

For strength and comfort, the grips 122, 132 and the opposing lateral supports 124, 134 may be constructed of rigid or semi-rigid materials. For example, and without limitation, the grips 122, 132 and the opposing lateral supports 124, 134 may be constructed of one or more of the following list of materials: rubber, plastic, aluminum, and carbon. In one embodiment, a portion of the grips 122, 132 may be adapted to engage a stop mount, such as a tow hook, on a water recreation device. In another embodiment, a portion of the grips 122, 132 may be textured to present a gripping surface to a rider of a water recreation device. In yet another embodiment, the grips 122, 132 and the lateral supports 124, 134 may be individual components that may be assembled to form the first and second drawbar members 120, 130, respectively. For example, and without limitation, the grips 122, 132 and the lateral supports 124, 134 of each of the first and second drawbar members 120, 130 may be integrally formed as a monolithic unit. Those skilled in the art will appreciate, after having had the benefit of reading this disclosure, that molding each of the drawbar members 120, 130 not only may result in reduced manufacturing costs when compared to assembly of multiple components, but also may increase the safety of the drawbars by minimizing potential failure points.

As shown in FIGS. 1C and 1D, a coupling member 140 may be connected to a portion of each of the opposing lateral supports 124, 134 on each of the first and second drawbar members 120, 130. For example, and without limitation, the anterior end 127 of lateral support 124 and the anterior end 137 of lateral support 134 may be connected to a posterior portion 145 of the coupling member 140. Continuing to refer to FIG. 1D, such connection may cause the first drawbar member 120 and the second drawbar member 130 to extend outwardly from the coupling member 140 in an angled configuration, with the coupling member substantially at the vertex of the angle formed by the first and second drawbar members 120, 130. Those skilled in the art will appreciate, after having had the benefit of reading this disclosure, that the first drawbar member 120, the second drawbar member 130, and the coupling member 140 may be integrally formed as a monolithic unit. For example, and without limitation, the entire tow rope system 100 may be molded during manufacturing.

Referring now to FIG. 1D, and in another embodiment, the coupling member 140 may include at least one gusset 160 adjacent the first and second drawbar members 120, 130. The gusset(s) 160 may be elastic so that an angle between the first and second drawbar members 120, 130 may be allowed to vary. Such flexibility in the physical configuration of the tow rope system 100 may support a range of comfort and performance requirements, depending on the use characteristics of a particular rider. For example, and without limitation, the variable angle between the drawbar members 120, 130 may be in the range of between about 15 degrees to 30 degrees. Those skilled in the art will appreciate, after having had the benefit of reading this disclosure, that the angle between the first and second drawbar members 120, 130 may be fixed at a single desired angle, or may be varied to any range of angles that supports the use characteristics, such as performance and ease of operation, desired by water recreation device riders of differing skill levels and recreational interests.

To strengthen the angle between the two drawbar members 120, 130, multiple gussets 160 may be spaced apart and substantially adjacent to opposing lateral supports 124, 134 included in the first and second drawbar members 120, 130. Those skilled in the art will appreciate, after having had the benefit of reading this disclosure, that the first drawbar member 120, the second drawbar member 130, the coupling member 140, and the at least one gusset 160 may be integrally formed as a monolithic unit. For example, and without limitation, the gusset(s) 160 may be molded during manufacturing as an integral part of the tow rope system 100.

Figure 1E:
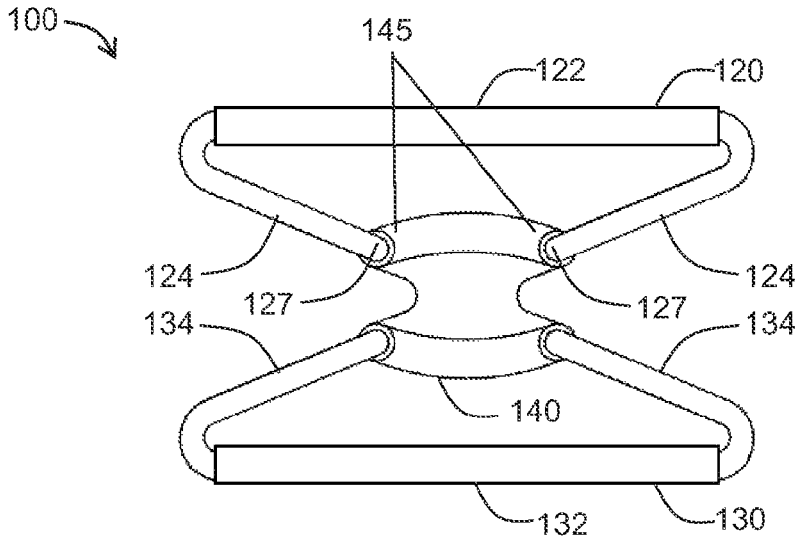
FIG. 1E is a rear elevation view of the tow rope system illustrated in FIG. 1A.
Figure 1F:
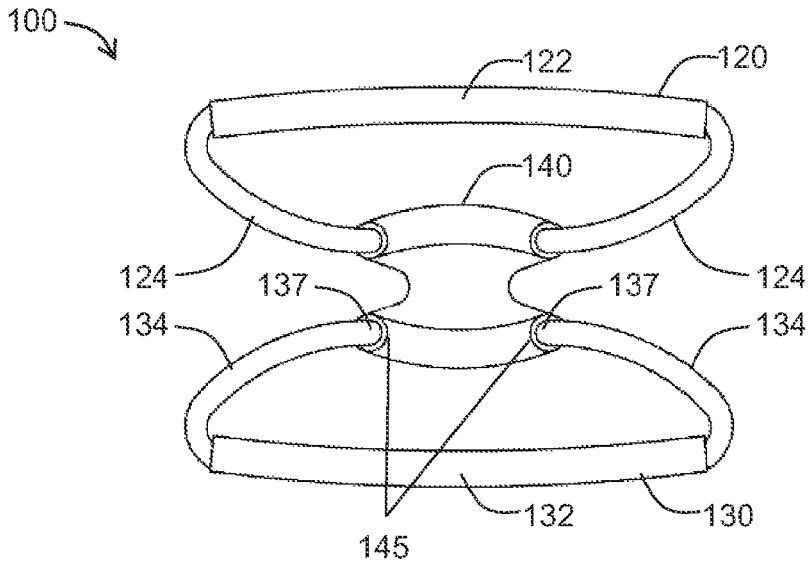
FIG. 1F is a rear elevation view of a tow rope system according to an alternative embodiment of the present invention.

Referring now to FIGS. 1D, 1E, and 1F, the grip 122 on the first drawbar member 120 may be spaced apart from the grip 132 on the second drawbar member 130, Due to this spacing, the grip 122 of the first drawbar member 120 may be elevated above the surface of a water recreation device when the grip 132 of the second drawbar member 130 is engaged with a mounted stop on the water recreation device, such as a surface-mounted tow hook as described below. Because this spacing of grip 122 from grip 132 results in the rider having to bend over less in order to grasp grip 122, such a configuration advantageously may provide for an easier reach for the rider compared to state-of-the-practice single-grip drawbars which are engaged flush with the surface of a water recreation device. Also, because this spacing of grip 122 from grip 132 results in grip 122 not physically touching the surface of a water recreation device, such a configuration advantageously may prevent pinching of the rider's fingers as is common to state-of-the-practice single-grip drawbars which are engaged flush with the surface of a water recreation device.

As shown in FIGS. 1D and 1E, in one embodiment, the space between the first and second drawbar members 120, 130 may result from the variable angle maintained by the coupling member 140. As shown in FIG. 1F, in another embodiment, the space between the first and second drawbar members 120, 130 may result from the grip 122 of the first drawbar member 120 and the grip 132 of the second drawbar member excurvating in relation to each other. Those skilled in the art will appreciate, after having had the benefit of reading this disclosure, that the grips 122, 132 of the first and second drawbar members 120, 130 may be formed as straight, curved, or contoured in a variety of configurations that accomplish separation of grip 122 from grip 132.

Figure 2A:
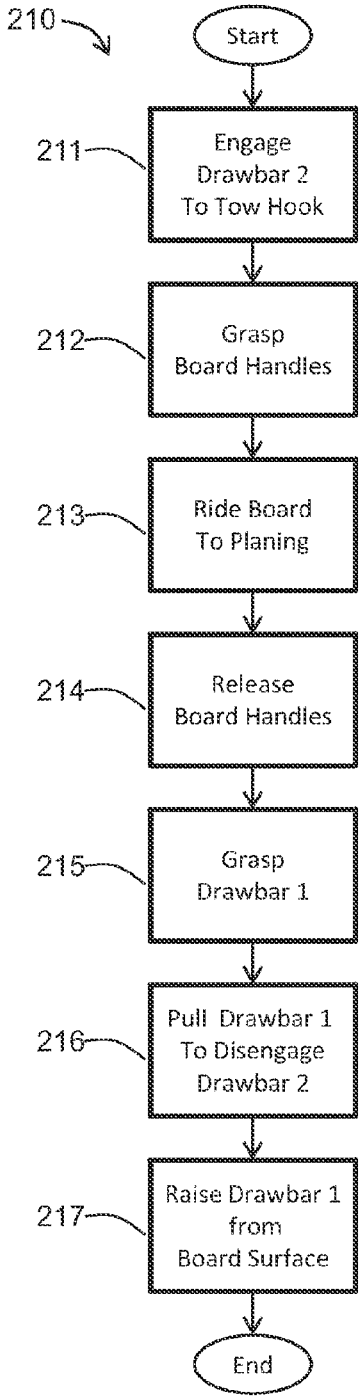
FIG. 2A is a flowchart illustrating a method of use of a tow rope system according to an alternative embodiment of the invention.
Figure 4A:
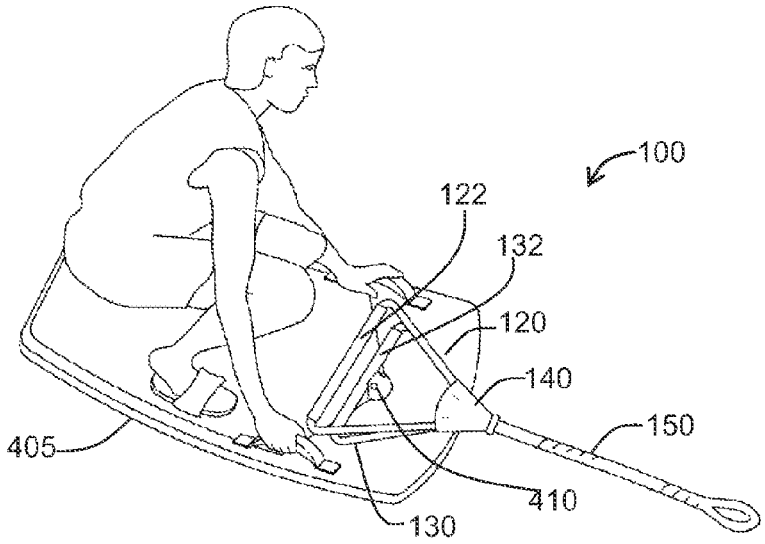
FIGS. 4A, 4B, and 4C are diagrams illustrating a transitioning of use of a tow rope system from passive to active towing of a rider of a water recreation device according to the method of FIG. 2A.
Figure 4B:
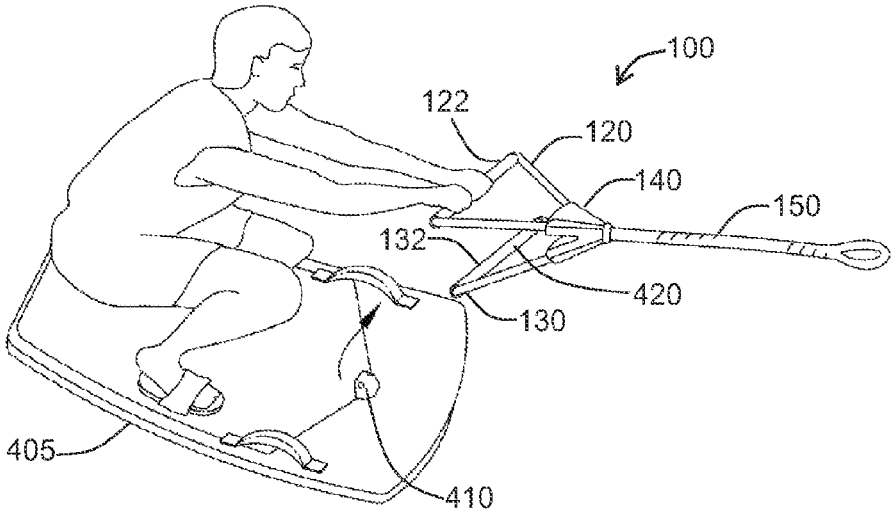
Figure 4C:
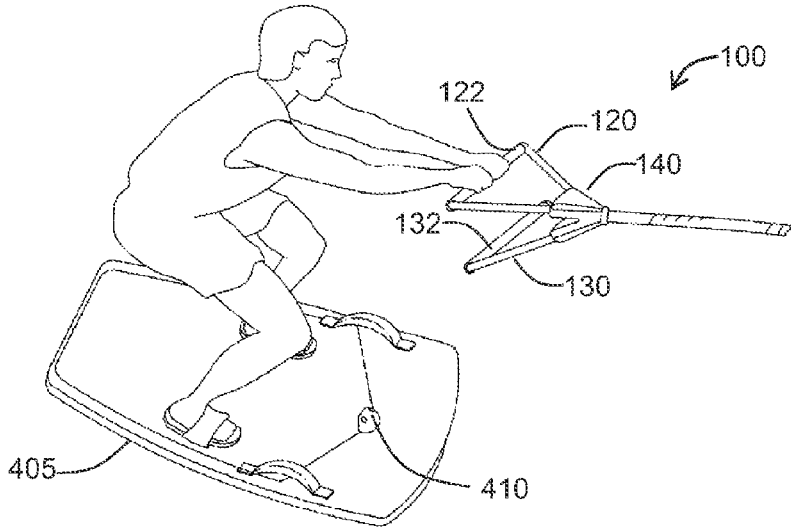
Figure 4D:
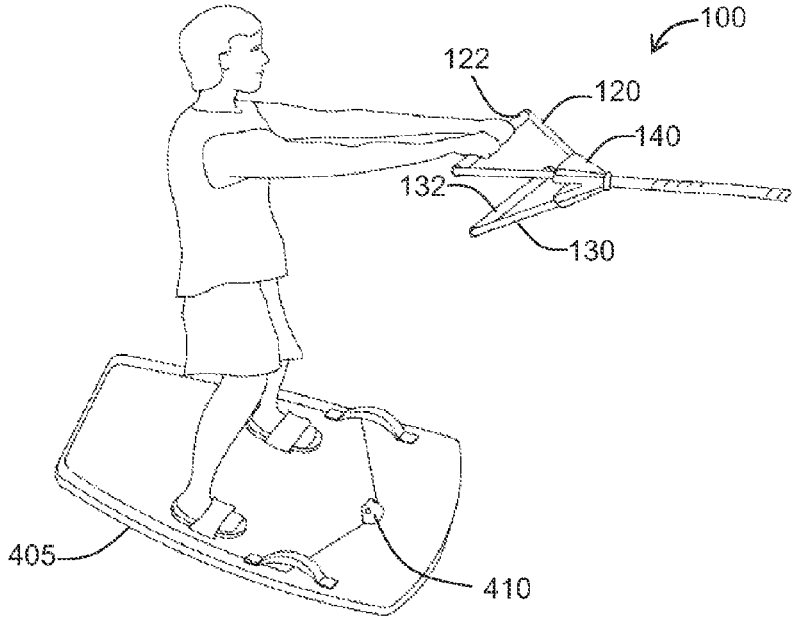
FIGS. 4D, 4E, and 4F are diagrams illustrating a positioning of a tow rope system for ergonomic gripping by a rider of a water recreation device according to the method of FIG. 3A.

Referring now additionally to FIG. 2A, a method aspect of the present invention is described in greater detail. The method according to the present invention, and as illustrated in the flowchart 210 of FIG. 2A and in the diagrams of FIGS. 4A, 4B, and 4C, is directed to transitioning from passive to active towing of a rider of a water recreation device 405 using a tow rope system 100 of the present invention. From the start, a contact surface 420 on the grip 132 of a second drawbar member 130 may be engaged with, for example and without limitation, a tow hook 410 (Block 211) that may be mounted on the surface of a water recreation device 405, as illustrated in the diagram at FIGS. 4A and 4B. The contact surface 420 may be positioned substantially central on the grip 132 of the second drawbar member 130. At Block 212 and as shown in FIG. 4A, the rider may grasp the handles mounted on the surface of the water recreation device 405 as the board is pulled to planing atop the water (Block 213) by a water vehicle. The rider may prepare to transition from passive towing mode to active towing mode by releasing the handles mounted to the water recreation device 405 (Block 214) and grasping the grip 122 of the first drawbar member 120 (Block 215) in a position that may be substantially central on the grip 122. At Block 216, the rider may pull back on the grip 122 of the first drawbar member 120, thereby disengaging the grip 132 of the second drawbar member 130 from the tow hook 410 of the board as illustrated in the diagram at FIG. 4B. To clear the grip 132 of the second drawbar member 130 from the vicinity of the tow hook 410, the rider may raise the grip 122 of the first drawbar member 120 away from the surface of the water recreation device 405 (Block 217), thereby causing the grip 132 of the second drawbar member 130 to hang freely below the first drawbar member 120 in an orientation substantially parallel to the surface of the riding board as illustrated in the diagram at FIG. 4C.

Figure 2B:
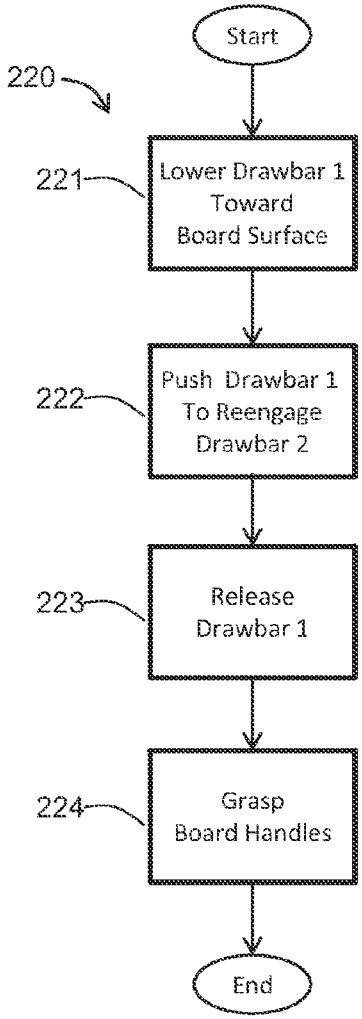
FIG. 2B is a flowchart illustrating another method of use of a tow rope system according to an alternative embodiment of the invention.

Referring now additionally to FIG. 2B, a method aspect of the present invention is now described in greater detail. The method according to the present invention, and as illustrated in the flowchart 220 of FIG. 2B, is directed to transitioning from active to passive towing of a rider of a water recreation device 405 using a tow rope system 100 of the present invention. The method starts at Block 221 where the rider may lower the grip 122 of the first drawbar member 120 toward the surface of the riding board, thereby causing the grip 132 of the second drawbar member 130 to hang freely below the first drawbar member 120 in an orientation substantially parallel to the surface of the riding board. At Block 222, the rider may push the grip 122 of the first drawbar member 120 away from the rider and generally toward the tow hook 410 mounted on the surface of the water recreation device 405, thereby mating the grip 132 of the second drawbar member 130 with the tow hook 410. In this way, the tow hook 410 reengages a contact surface 420 on the grip 132 of the second drawbar member 130, the contact surface 420 positioned substantially central on the grip 132 of the second drawbar member 130. At Block 223, the rider may remove his hands from the grip 122 of the first drawbar member 120. The method is ended at Block 224, where the rider may grasp the handles mounted on the surface of the board to reestablish support.

Accordingly, the methods illustrated in the flowchart 210 in FIG. 2A and flowchart 220 in FIG. 2B allow a rider of a water recreation device 405 to advantageously manipulate the tow rope system 100 to comfortably and efficiently disengage and reengage the drawbar apparatus in relation to a tow hook 410 on a water recreation device 405.

Figure 3A:
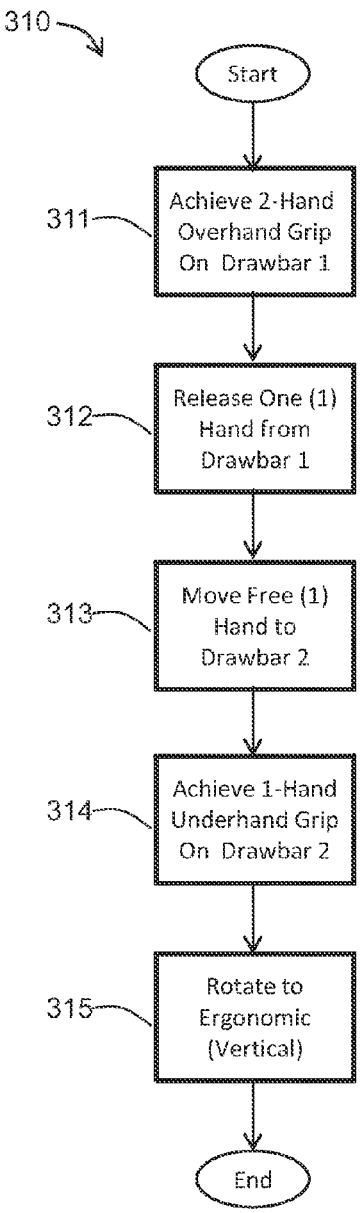
FIG. 3A is a flowchart illustrating another method of use of the tow rope system according to an alternative embodiment of the invention.
Figure 4E:
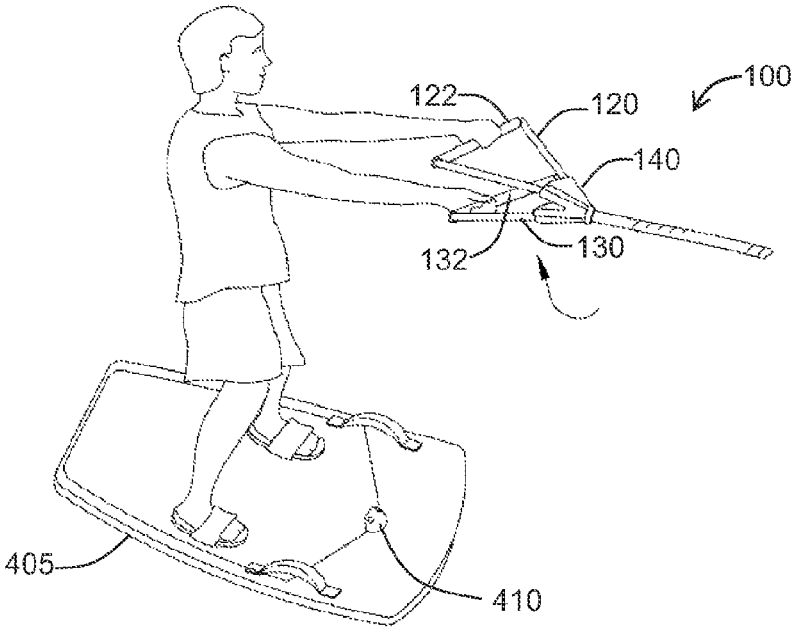
Figure 4F:
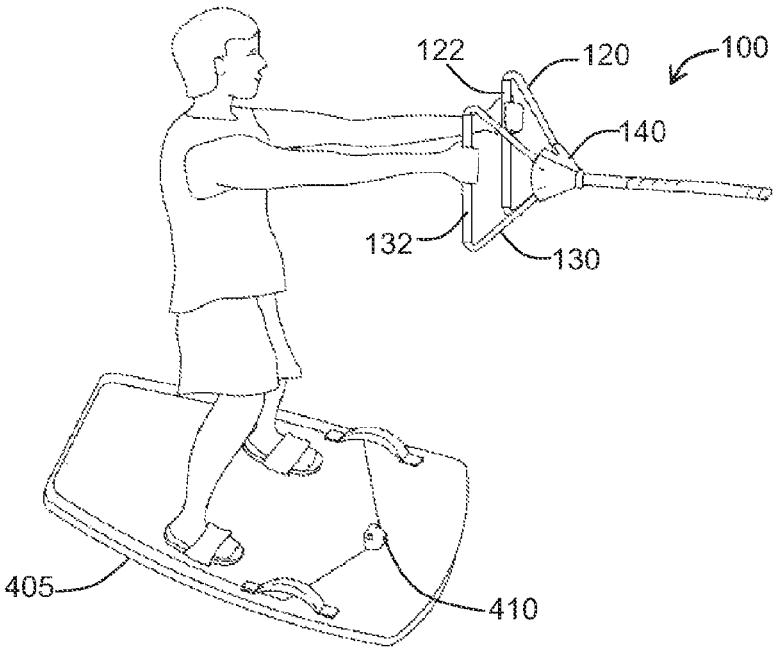

Referring now additionally to flow chart 310 illustrated in FIG. 3A, a method aspect of the present invention is now described in greater detail. In the present method, the rider may selectively transition the tow rope system 100 from a traditional gripping technique to an ergonomic gripping technique. The method starts at Block 311 where both hands of the rider may be assumed to begin in a traditional overhand technique on the grip 122 of the first drawbar member 120 as illustrated in the diagram at FIG. 40. The rider may remove one hand (either left or right) from the grip 122 of the first drawbar member 120 (Block 312). At Block 313, the rider may grasp the grip 132 of the second drawbar member 130 using the free hand of the rider, When grasping the grip 132, the rider may employ an underhand technique (Block 314) with a hand position substantially central on the grip 132 of the second drawbar member 130 as illustrated in the diagram at FIG. 4E. At ending Block 315, the rider may rotate the tow rope system 100 to achieve a substantially perpendicular orientation of the grips 122, 132 of the first and second drawbar members 120, 130 in relation to the surface of the riding board as illustrated in the diagram at FIG. 4F.

Figure 3B:
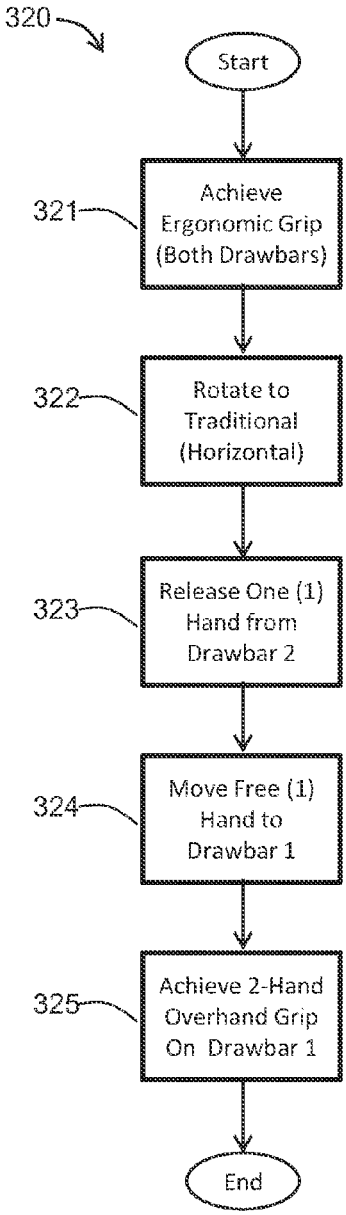
FIG. 3B is a flowchart illustrating another method of use of tow rope system according to an alternative embodiment of the invention.

Referring now additionally to FIG. 3B, a method aspect of the present invention is now described in greater detail. The method according to the present invention, and as illustrated in the flowchart 320 of FIG. 3B, is directed to selectively transitioning the tow rope system 100 from an ergonomic gripping technique to a traditional gripping technique. The method starts at Block 321 where each hand of the rider may be assumed to begin in an ergonomic technique (single-grip, side-by-side) on the grips 122, 132 of the first and second drawbar members 122, 132. The rider may rotate the tow rope system 100 to achieve a substantially parallel orientation of the grips 122, 132 of the first and second drawbar members 120, 130 in relation to the surface of the riding board (Block 322). At Block 323, the rider may remove a hand from the grip 132 of the second drawbar member 130. This free hand of the rider may join the rider's other hand in grasping the grip 122 of the first drawbar member 120 (Block 324) in an overhand technique (Block 325).

Accordingly, the methods illustrated in the flowchart 310 in FIG. 3A and flowchart 320 in FIG. 3B allow a rider of a water recreation device 405 to advantageously reposition the tow rope system 100 to either a traditional or ergonomic gripping technique while being pulled on a water recreation device 405.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A tow rope system for use with a water recreation device, comprising:

first and second drawbar members, each of the first and second drawbar members including a grip, and opposing lateral supports connected to the grip; and a coupling member connected to a portion of each of the opposing lateral supports on each of the first and second drawbar members; wherein the first drawbar member is positioned to overlie the second drawbar member; wherein the first and second drawbar members extend outwardly from the coupling member in an angled configuration, said coupling member including an elastic gusset between said opposed lateral elements such that said angled configuration may vary between said respective overlying drawbar members; and, further comprising a second gusset so as to define a pair of gussets; wherein the first gusset extends between a first one of the lateral supports on the first drawbar and a first one of the lateral supports on the second drawbar; and wherein the second gusset is positioned opposite the first gusset and extends between a second one of the lateral supports of the first drawbar and a second one of the lateral supports of the second drawbar.

2. A tow rope system according to claim 1 wherein each of the first and second drawbar members has a closed geometric shape.

3. A tow rope system according to claim 2 wherein the closed geometric shape defines an enclosed void.

4. A tow rope system according to claim 1 wherein each lateral support of each of the first and second drawbar members has an anterior end and a posterior end, the posterior end connected to a portion of the grip and the anterior end connected to a posterior portion of the coupling member.

5. A tow rope system according to claim 1 wherein each drawbar member is substantially triangular.

6. A tow rope system according to claim 1 wherein the grip of the first drawbar member is spaced apart from the grip of the second drawbar member.

7. A tow rope system according to claim 1 wherein the first drawbar member and the second drawbar member excurvate in relation to each other.

8. A tow rope system according to claim 1 wherein the grip and the lateral supports of each of the first and second drawbar members are integrally formed as a monolithic unit; and wherein the first drawbar member, the second drawbar member and the coupling member are integrally formed as a monolithic unit.

9. A tow rope system according to claim 1, wherein the first drawbar member, the second drawbar member, the coupling member, and the gusset are integrally formed as a monolithic unit.

10. A tow rope system according to claim 1 further comprising a leader having first and second ends, wherein the first end of the leader is connected to an anterior portion of the coupling member and a tow rope is connectable to the second end of the leader.

11. A tow rope system according to claim 1 wherein a portion of each of said grips is adapted to engage a tow hook on a water recreation device.

12. A tow rope system according to claim 1 wherein a portion of the grip is textured to present a gripping surface to a rider of a water recreation device.

13. A tow rope system for use with a water recreation device, comprising:

first and second drawbar members, each of the first and second drawbar members including a grip, and opposing lateral supports connected to the grip, each lateral support having an anterior end and a posterior end, the posterior end connected to a portion of the grip;

a coupling member connected to the anterior ends the opposing lateral supports; wherein the first drawbar member is positioned to overlie the second drawbar member; wherein the first and second drawbar members extend outwardly from the coupling member in an angled configuration; wherein the first drawbar member and the second drawbar member excurvate in relation to each other; wherein the coupling member further comprises at least one elastic gusset adjacent the first and second drawbar members; wherein the first drawbar member, the second drawbar member, the coupling member, and the at least one gusset are integrally formed as a monolithic unit; and, further comprising a second gusset so as to define a pair of gussets; wherein the first gusset extends between a first one of the lateral supports on the first drawbar and a first one of the lateral supports on the second drawbar; and wherein the second gusset is positioned opposite the first gusset and extends between a second one of the lateral supports of the first drawbar and a second one of the lateral supports of the second drawbar.

14. A tow rope system according to claim 13 wherein a portion of each of the respective grips is adapted to engage a tow hook on a water recreation device.

15. A tow rope system according to claim 13 wherein at least a portion of at least one of the grips is textured to present a gripping surface to a rider of a water recreation device.

* * * * *